US006383125B1

(12) United States Patent
Schwarz

(10) Patent No.: US 6,383,125 B1
(45) Date of Patent: May 7, 2002

(54) PAGE INDICATOR TAB FORMER

(76) Inventor: Stefan Schwarz, 2697 Aubrey Dr., Orion Township, MI (US) 48360

( * ) Notice: Subject to any disclaimer, the term of this patent is extended or adjusted under 35 U.S.C. 154(b) by 0 days.

(21) Appl. No.: 09/392,518

(22) Filed: Sep. 9, 1999

(51) Int. Cl.[7] ..... B31F 7/00
(52) U.S. Cl. ..... 493/356
(58) Field of Search ..... 493/356, 396, 493/405

(56) References Cited

U.S. PATENT DOCUMENTS 766,905 A * 8/1904 Ruth ..... 493/405
768,484 A * 8/1904 Ruth ..... 493/356
1,229,213 A * 6/1917 Bernard ..... 493/356
1,232,541 A * 7/1917 Hawkins ..... 493/356
2,300,623 A 11/1942 Hornung
2,941,819 A 6/1960 Groody
3,409,312 A 11/1968 Wills
4,184,699 A 1/1980 Lowe, Jr.
5,336,155 A * 8/1994 Studebaker ..... 493/405
5,989,173 A * 11/1999 Lugea et al. ..... 493/356

* cited by examiner

*Primary Examiner*—Rinaldi I. Rada
*Assistant Examiner*—John Paradiso
(74) *Attorney, Agent, or Firm*—Young & Basile, PC

(57) ABSTRACT

A device for cutting and folding back a portion of a page along a peripheral edge to form a tab that extends beyond the peripheral edge. The device includes a first and second planar member and a folded over cutting blade positioned to extend laterally over the second member and partially over the first member. The folded over cutting blade forms two cutting edges and having an opening therebetween for receiving a portion of the page. In another aspect, the device includes a housing having an upper and lower structure forming a narrow cavity along one side for disposition of a page of a book, magazine or other publication. An interior edge of the cavity defines an alignment edge for the page. An actuator communicates with a cutting blade within the housing to cut a portion of the page within the cavity and fold the cut portion along a seam line so that the cut portion extends beyond the periphery of the page.

13 Claims, 2 Drawing Sheets

PAGE INDICATOR TAB FORMER

FIELD OF THE INVENTION

The invention relates to a page marking means for books, magazines, etc., and in particular to a device that cuts a portion along the periphery of the page and folds the portion to provide a tab extending beyond the periphery of the page.

BACKGROUND OF THE INVENTION

There are various techniques available for marking a page in a book or magazine. Such techniques range from bookmarks to paper clips to tabs that can be adhesively secured to an edge of a page. In all of these instances a supply of the bookmarks, paper clips, or tabs is needed for marking each page that needs to be designated. Therefore, if a large number of pages need to be designated for future location the same amount of bookmarks or paper clips will be needed. In cases where it is necessary to indicate a specific line as well as the page, bookmarks fail to provide that feature. Further, tabs that are adhesively placed along the edge of a page are not reusable and are generally destroyed when a magazine or paperback book is discarded.

Therefore, it is desirable to provide a device that will quickly place a tab so that it is extending from a peripheral edge of a page such that the tab is disposable without any cost to the owner of the book or magazine. Further, it is desirable to provide a tab that can be placed at a particular line on a page.

SUMMARY OF THE INVENTION

The invention provides a page indicator for placing a tab on a predetermined page of a book, magazine, or other publication. The page indicator includes a device having means for cutting an edge portion of a page so that it is situated along the peripheral edge of the page. The device further provides a means to fold over the end portion after cutting so that the cut end portion extends beyond the peripheral edge of the page to form a tab. In one aspect of the invention, the page indicator includes a means for actuating the cutting and folding means.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DETAILED DESCRIPTION OF THE PREFERRED EMBODIMENTS

Figure 1A:
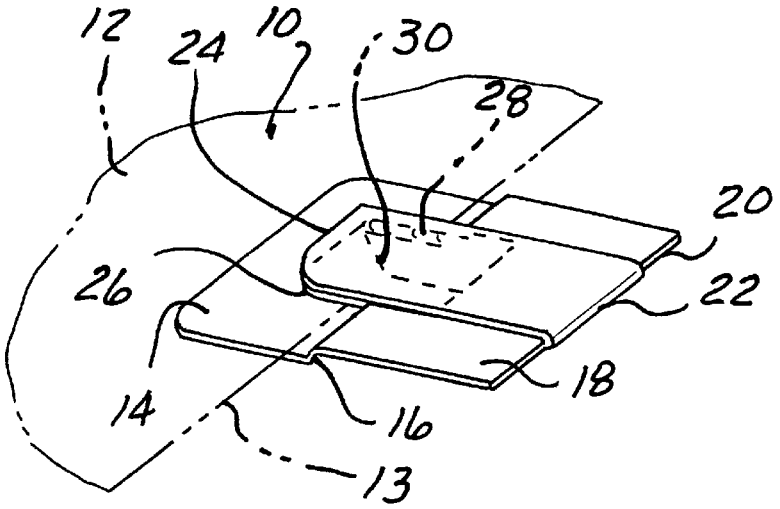
FIG. 1*a* is a perspective of a page indicator tab former according to a first embodiment of the invention providing a blade for cutting a partial notch along the periphery of a page.

The first embodiment (FIG. 1*a*.) of the present invention is a simplified page indicator tab former which provides a blade for cutting a portion of a page along the periphery of the page. The device is preferably made from a suitable material, such as a metal or plastic, and includes a first planar member 14 for placement of the page or sheet of paper 12 thereon. The first planar member 14 terminates along one edge of a shelf or raised portion which defines an alignment edge 16 for one edge of the paper 12. The shelf then extends to a second planar member 18. The second planar member 18 terminates at a distal end from the shelf 16 at a second edge 20. A folded over cutting blade 22 is positioned to extend laterally across the second planar member 18 and partially over the first member 14 such that a first cutting edge 24 is positioned over the alignment edge 16 and the first member 14. A second cutting edge 26 is positioned to extend through the alignment edge or beneath the alignment edge 16 and the first member 14. Therefore, an edge 13 of a sheet of paper 12 positioned against the alignment edge 16 would be also positioned between the first cutting edge 24 and the second cutting edge 26. The cutting blade 22 is configured to have a generally rectangular or squared configuration with an arcuate corner at the cutting edge. The arcuate corner can be replaced with an angled edge, at 90° edge, or even an irregular shaped edge. The configuration of the blade 22 is only a partial rectangular configuration since one end of the cutting edge 26 has an angled portion 28 to prevent cutting the paper 12 along edge 30 so that a complete notch in the paper 12 is not made. The edge 30 produces an indent or fold line 64 in the paper 12 as a mark to indicate where to fold the paper over to produce a tab. The first and second members 14 and 18 and the cutting blade are illustrated as being formed of a one piece unitary structure; but may also be formed of two or more parts bonded or united together. As an alternative, blade 22 and the two planar members 14 and 18 can be manufactured as two metal or plastic parts bonded or united together.

To form a tab using the device according to the first embodiment, the page of paper 12 is placed on the first planar member 14 such that the outer edge 13 of the page abuts against the alignment edge 16. The upper portion of the first cutting 24 edge is depressed to produce the desired cut on the page 12. The page 12 is removed from the device 10 and then the cut portion of the page is manually folded by the user at the indent or fold line 64 to fold the cut portion beyond the periphery 13 of the page to provide the tab 66 shown on FIG. 1*b*.

Figure 1B:
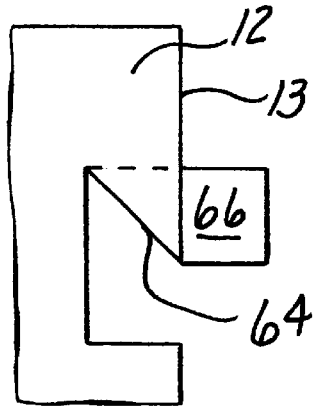
FIG. 1*b* is a plan view of a tab formed on a page by a page indicator tab former of the present invention.
Figure 2:
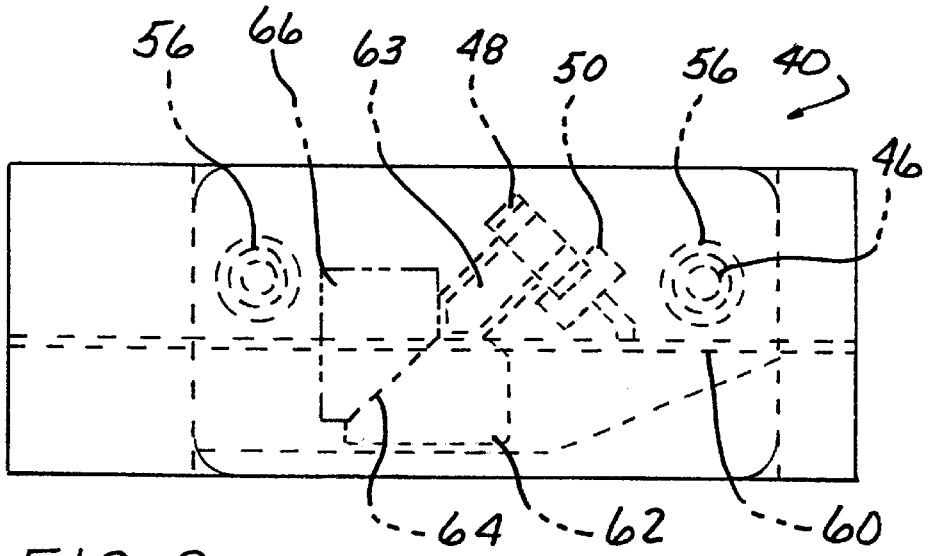
FIG. 2 is a top plan view of the page indicator tab former according to the present invention.
Figure 3:
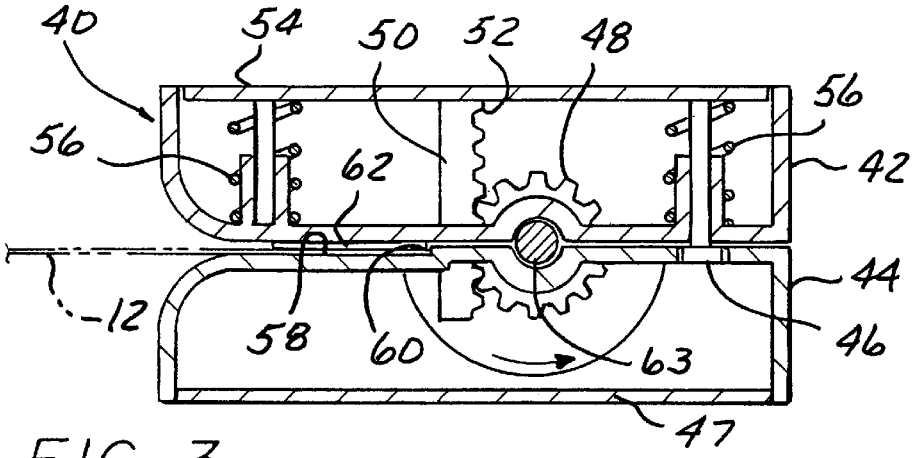
FIG. 3 is a diagrammatic cross-section view of a second embodiment of a page indicator tab former according to the present invention having a lever for actuating a cutting and folding blade.

FIGS. 2 and 3 show an alternate and one of the preferred embodiments of the present invention. In this and succeeding embodiments the page indicator tab former both cuts a portion of a page and then folds the cut portion to form the tab 66 shown in FIG. 1*b*. The page indicator tab former 40 shown in FIGS. 2 and 3 includes an upper housing 42 and a lower housing 44. The upper housing 42 and the lower housing 44 are held together by a nut and bolt assembly 46. The upper and lower housings may also be welded together or glued together. The lower housing 44 may be enclosed with a separate bottom plate 47. Disposed between the upper and lower housings 42, 44, respectively, is a gear 48 and ratchet 50 assembly. The gear and ratchet assembly communicates with both a cutting blade 62 located within the housing 42, 44 and an actuating means exposed outside of the housing. The ratchet 50 has an upper end 52 connected to a lever 54. The lever 54 provides a top cover for the upper housing 42 as well as the actuating means for the cutting blade 62. The lever 54 is maintained in position when not in use by springs 56 in the upper housing 42. The springs 56 are biased to hold the lever 54 level with the top of the upper housing 42.

As shown in FIG. 2, on one side of the device 40, a cavity 58 is formed between the upper and lower housings 42, 44 for placement of a page 12 from a book or other publication. The innermost surface of the cavity 58 in the lower housing 44 forms a ledge 60 for alignment with the edge 13 of a sheet of paper 12. A cutting and folding blade 62 is also exposed within cavity 58. The blade 62 is attached to an axle 63 and rotatably sealed in the housings 42, 44. One end of the axle 63 is attached to gear 48. This is shown more clearly in FIG. 2. The cutting and folding blade 62 communicates with gear 48 such that when gear 48 rotates counter-clockwise the cutting and folding blade 62 is depressed into the sheet of paper 12 within the cavity 58 and cuts a portion of a rectangular shape similar to the shape as shown in FIG. 3. As the cutting and folding blade 62 continues the revolution into the lower housing 44 the cut portion of the sheet of paper 12 is folded along the seam/fold line 64 such that it is now positioned as shown in FIG. 3 at 66 (in phantom). The resultant tab 66 is shown in FIG. 1*b*.

The cutting and folding blade 62 is actuated by depressing lever 54 against the resistance of the springs 56. As the lever 54 is depressed, ratchet 50 is also depressed. The gear 48 is enmeshed with the ratchet 50 such that the linear movement of the ratchet 50 forces gear 48 to rotate. As gear 48 rotates, axle 63 rotates the cutter 62 onto the sheet of paper 12 to cut a portion of the sheet and then continues to fold the cut portion along seam line 64 to provide the tab as shown at 66 in FIGS. 1*b* and 3. When the lever 54 is released, the cutting and folding blade 62 returns to its original position.

Figure 4:
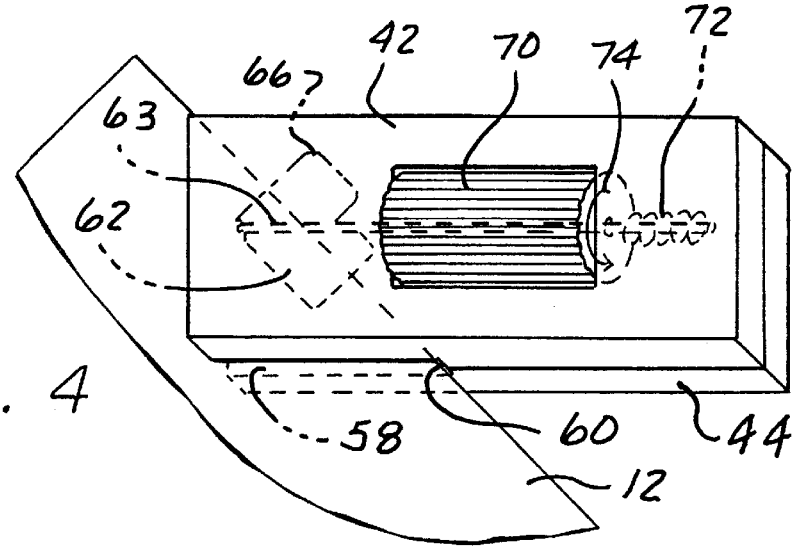
FIG. 4 is a perspective view of a third embodiment of the invention having a turn knob for actuating the cutting and folding blade.

FIG. 4 shows another embodiment of the page indicator tab former of FIGS. 2 and 3. This embodiment provides a turnable knob 70 for actuating the cutting and folding blade 62. The knob 70 rotates about axle 63. Knob 70 is connected at one end to a torsional or other type of spring 72 and is connected at the other end to the cutting and folding blade 62. Once a page 12 of a publication is inserted within the cavity 58 such that the edge 13 of the page 12 is placed against the inner surface or ledge 60 of the lower housing 44, an operator can activate the cutter 62 by turning the knob 70 in the direction of arrow 74, the cutting blade 62 is rotated through the paper 12 to cut the predetermined shaped tab configuration. The cutting blade 62 continues to rotate to fold the cut portion and form the tab 66 as shown in FIG. 1*b*. The revolution of the cutting blade 62 can be limited by the spring tension or by limiters on the sliding or rotatable knobs or by the travel length of ratchet 50. When the knob 70 is released, the spring 72 causes the knob to turn in the opposite direction of arrow 74 which releases the blade 62 from the paper.

Figure 5:
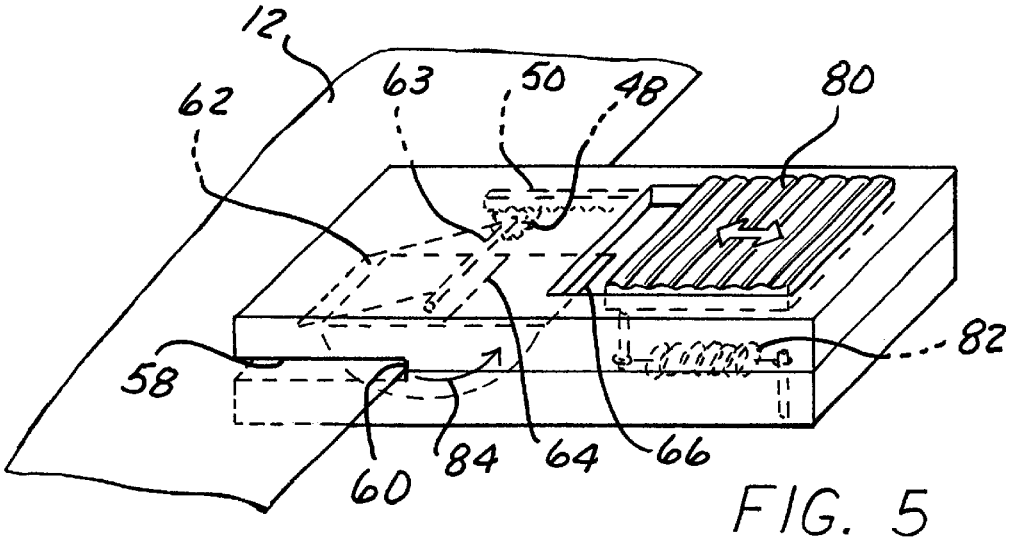
FIG. 5 is a perspective view of a fourth embodiment of the invention having a sliding knob for actuating the cutting and folding blade.

Another embodiment, shown in FIG. 5, replaces the lever 54 and knob 70 of the preceding embodiments with a sliding knob 80. The sliding knob 80 communicates with a spring 82 which biases the knob 80 away from the cavity 58. The sliding knob 80 also communicates with the cutting and folding blade 62 through the ratchet and gear assembly 50, 48, respectively. The axle 63 is connected to gear 48 and blade 62 extends from one side of the axle 63. As the sliding knob 80 is moved toward the cutting and folding blade, the ratchet 50 moves in the same direction as sliding knob 80. As the ratchet 50 moves, gear 48 and axle 63 rotate in a counter-clockwise direction as indicated by arrow 84 so that the cutting blade 62 cuts the sheet of paper 12 located within the cavity 58. Cutting and folding blade 62 further folds the cut portion of the page along seam line 64 to provide tab 66 wherein the tab 66 is exposed beyond the periphery of the edge 13 of the page 12. When the sliding knob 80 is released, the spring 82 biases the sliding knob 80 and cutting blade 62 back to their original positions. In other words, the cutting blade 62 is again positioned in the upper housing 42 directly above the cavity 58.

The subject invention provides a device to easily position a tab on a page to mark a particular page and/or line on a page. The cutting blade can provide one of various decorative tabs by configuring the cutting blade with angled, arcuate, or irregular shaped edges. The device eliminates the concern of lost markers or having an adequate supply of markers. Of course, if the tab is no longer needed, the tab may be folded back to its original position. Therefore, the device also eliminates the waste of adhesively applied markers on discarded publications.

What is claimed is:

1. A page indicator for placing a tab on a predetermined page for books, magazines and other publications comprising:

means for cutting an edge portion of the predetermined page along a peripheral edge of the page to form a cut portion integrally attached at one end to the page;

means for forming a folding line on the cut portion, wherein the means for cutting and the means for forming a folding line are movable for cutting the edge; and folding means movable along the folding line to fold the cut portion along the fold line and move an end of the cut portion externally outward of the peripheral edge of the page.

2. The page indicator of claim 1 further comprising a means for aligning the page so that the cutting means cuts along the peripheral edge.

3. The page indicator of claim 1, wherein the means for cutting and folding is a blade.

4. The page indicator of claim 1, wherein the actuating means includes a movable knob communicating with the cutting means such that when the knob is moved in a first direction, the cutting means cuts the edge portion.

5. The page indicator of claim 1, wherein the actuating means includes a mating gear and a ratchet and an axle, wherein said axle is connected to the gear.

6. The page indicator of claim 5, wherein the cutting means includes a blade having a portion attached to the axle.

7. The page indicator of claim 1, wherein the cutting means is enclosed in a housing.

8. The page indicator of claim 6, wherein the blade is enclosed in a housing.

9. The page indicator of claim 6, wherein the blade folds the edge portion after cutting.

10. The page indicator of claim 5 further comprising means to limit the movement of the blade.

11. The page indicator of claim 1, wherein the actuating means further comprises a sliding knob communicating with a gear and ratchet assembly.

12. The page indicator of claim 7, wherein the housing includes a cavity for receiving the page and exposing the page to the blade.

13. A method for forming a tab on a predetermined page of books, magazines, and other publications comprising the steps of:

cutting an edge portion of the predetermined page along a peripheral edge of the page to form a cut portion integrally attached at one end to the page;

forming a folding line on the cut portion; and folding the cut portion of the predetermined page on the folding line and moving an end of the cut portion externally outward beyond the peripheral edge of the page.

* * * * *